US009051079B2

(12) United States Patent
Kuo et al.

(10) Patent No.: US 9,051,079 B2
(45) Date of Patent: Jun. 9, 2015

(54) PALLET

(71) Applicant: Shenzhen China Star Optoelectronics Technology Co., Ltd., Shenzhen, Guangdong (CN)

(72) Inventors: Yicheng Kuo, Shenzhen (CN); Shihhsiang Chen, Shenzhen (CN); Chengwen Que, Shenzhen (CN); Jiahe Cheng, Shenzhen (CN); Qinjun Shi, Shenzhen (CN); Jiaxin Li, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 172 days.

(21) Appl. No.: 13/805,664

(22) PCT Filed: Nov. 8, 2012

(86) PCT No.: PCT/CN2012/084257

§ 371 (c)(1),
(2) Date: Dec. 20, 2012

(87) PCT Pub. No.: WO2014/059710

PCT Pub. Date: Apr. 24, 2014

(65) Prior Publication Data

US 2014/0110551 A1 Apr. 24, 2014

(30) Foreign Application Priority Data

Oct. 19, 2012 (CN) ..... 2012 1 0401357

(51) Int. Cl.
*A47B 91/00* (2006.01)
*B65D 19/00* (2006.01)

(52) U.S. Cl.
CPC .. *B65D 19/0002* (2013.01); *B65D 2519/00273* (2013.01); *B65D 2519/00323* (2013.01);

(Continued)

(58) Field of Classification Search
CPC ..... B65D 19/06; B65D 19/38
USPC ..... 248/346.02, 346.06, 346.07; 108/54.1, 108/55.1, 56.1; 312/205; 411/455
See application file for complete search history.

(56) References Cited

U.S. PATENT DOCUMENTS 2,739,776 A 3/1956 Terando
2,764,377 A * 9/1956 Schoenecker ..... 108/54.1

(Continued)

FOREIGN PATENT DOCUMENTS

CN 202400363 U 8/2012
CN 202489740 U 10/2012

(Continued)

*Primary Examiner* — Monica Millner
(74) *Attorney, Agent, or Firm* — Andrew C. Cheng

(57) ABSTRACT

The present invention provides a pallet, which includes a base board and first secondary boards movably coupled to two opposite sides of the base board, and first coupling axles connecting between the base board and the first secondary boards. Each first coupling axle includes a first base from which a first extension section extends. The first extension section forms first flexible engagement keys. The base board forms first receiving sections corresponding to the first bases and also forming first track channels corresponding to the first extension sections. Each first track channel forms therein first retention slots corresponding to the first flexible engagement keys. The first bases are movably received in the first receiving slots. The first flexible engagement keys are receivable in the first retention slots to retain the first coupling axles in the base board. The first extension sections have ends fixed in the first secondary boards.

11 Claims, 3 Drawing Sheets

(52) U.S. Cl.
CPC ..... *B65D2519/00761* (2013.01); *B65D 2519/00293* (2013.01); *B65D 2519/00338* (2013.01); *B65D 2519/00348* (2013.01); *B65D 2519/00572* (2013.01)

(56) References Cited

U.S. PATENT DOCUMENTS

| | | | | | |
|---|---|---|---|---|---|
| 2,909,350 | A | * | 10/1959 | Morris | 108/54.1 |
| 2,942,827 | A | * | 6/1960 | Edson | 108/54.1 |
| 3,314,699 | A | * | 4/1967 | Taylor | 403/14 |
| 3,650,225 | A | * | 3/1972 | Ball | 108/57.17 |
| 3,695,187 | A | * | 10/1972 | Weiss | 108/54.1 |
| 3,826,206 | A | * | 7/1974 | Ruggles | 108/64 |
| 4,705,276 | A | * | 11/1987 | Kastle et al. | 273/309 |
| 4,895,080 | A | * | 1/1990 | Thomas | 108/56.1 |
| 5,706,738 | A | * | 1/1998 | Rapeli | 108/54.1 |
| 6,112,673 | A | * | 9/2000 | Gomez | 108/56.1 |
| 6,536,147 | B1 | * | 3/2003 | Funk et al. | 40/605 |
| 7,360,493 | B2 | * | 4/2008 | Hummel et al. | 108/54.1 |
| 7,490,561 | B1 | * | 2/2009 | Chou | 108/56.1 |
| 8,671,849 | B2 | * | 3/2014 | Krieg | 108/53.1 |
| 2007/0025829 | A1 | * | 2/2007 | Sutt | 411/455 |
| 2008/0236455 | A1 | * | 10/2008 | Naidu | 108/56.1 |
| 2012/0048169 | A1 | * | 3/2012 | Linares | 114/266 |

FOREIGN PATENT DOCUMENTS

| | | | | |
|---|---|---|---|---|
| DE | 4135912 | A1 | * | 5/1993 |
| GB | 2354505 | A | | 3/2001 |
| JP | 2000043868 | A | | 2/2002 |
| JP | 2005053578 | A | | 3/2005 |

* cited by examiner

PALLET

BACKGROUND OF THE INVENTION

1. Field of the Invention

The present invention relates to the field of packaging material, and in particular to a pallet used in a liquid crystal panel package box.

2. The Related Arts

In the field of manufacture of liquid crystal display devices, the manufacture of liquid crystal display devices includes a process of assembling, which assembles various components, including a liquid crystal panel, a main control circuit, and an enclosure, together. These components are each manufactured in advance and packaged for being later assembled to form a complete liquid crystal display device. The liquid crystal panel, after being manufactured, are packaged in a package box and then shipped to a corresponding assembling station with the box. The package box is generally integrally formed with blow molding and has a bottom at which a pallet is mounted to support liquid crystal panels stacked thereon. Such a pallet is generally rigid and unitary and is thus only fit for a specific size of liquid crystal panel. In addition, the amount of space that it takes for warehousing and transportation is relatively large, making it hard for cost control.

SUMMARY OF THE INVENTION

An object of the present invention is to provide a pallet, which has an adjustable size to be fit for packaging of various sizes of liquid crystal panel and occupies a small amount of space for warehousing and transportation.

To achieve the object, the present invention provides a pallet, which comprises a base board and first secondary boards movably coupled to two opposite sides of the base board, and first coupling axles connecting between the base board and the first secondary boards. The first coupling axles each comprise a first base and a first extension section extending from the first base. The first extension section forms a plurality of first flexible engagement keys at locations close to an end thereof that is adjacent to the first base. The base board forms first receiving sections respectively corresponding to the first bases and also forms first track channels respectively corresponding to the first extension sections. The first track channels each form therein a plurality of groups of first retention slots corresponding to the first flexible engagement keys. The first bases are respectively received in the first receiving slots and movable in the first receiving slots. The first flexible engagement keys are receivable in and retained by the first retention slots to retain the first coupling axles in the base board. The first extension sections have free ends respectively fixed in the first secondary boards to movably couple the first secondary boards to the base board.

The first secondary boards each form a first mounting hole corresponding to the first extension section of each of the first coupling axles. The first extension sections of the first coupling axles are mounted in the first mounting holes so as to movably couple the first secondary boards to the base board.

The first extension section of each of the first coupling axles is cylindrical and the first flexible engagement keys are circumferentially formed on an outside surface of the first extension section at locations close to the first base.

The first flexible engagement keys are of a number of four and each of the groups of the first retention slots comprises four slots. The four slots respectively receive four first flexible engagement keys.

The base board is rectangular and has another two sides to which second secondary boards are movably coupled. The second secondary boards are movably connected to the base board by second coupling axles.

The second coupling axles each comprise a second base and a second extension section extending from the second base. The second extension section forms a plurality of second flexible engagement keys at locations close to an end thereof that is adjacent to the second base. The base board forms second receiving sections corresponding to the second bases and also forms second track channels corresponding to the second extension sections. The second track channels each form therein a plurality of groups of second retention slots corresponding to the second flexible engagement keys. The second bases are respectively received in the second receiving slots and are movable in the second receiving slots. The second resilient engagement keys are receivable in and retained by the respective second retention slots to thereby retain the second coupling axles in the base board. The second extension sections have free ends that are respectively fixed in the second secondary boards to thereby movably couple the second secondary boards to the base board.

The second secondary boards each form a second mounting hole corresponding to the second extension section of each of the second coupling axles. The second extension sections of the second coupling axles are respectively mounted in the second mounting holes so as to movably couple the second secondary boards to the base board.

The pallet further comprises third secondary boards movably connected to opposite sides of each of the second secondary boards. The third secondary boards are movably connected to the second secondary boards by third coupling axles.

The third coupling axles each comprise a third base and a third extension section extending from the third base. The third extension section forms a plurality of third flexible engagement keys at locations close to an end thereof that is adjacent to the third base. The second secondary boards each form third receiving sections corresponding to the third bases and also form third track channels corresponding to the third extension sections. The third track channels each form therein a plurality of groups of third retention slots corresponding to the third flexible engagement keys. The third bases are respectively received in the third receiving slots and are movable in the third receiving slots. The third resilient engagement keys are receivable in and retained by the respective third retention slots to thereby retain the third coupling axles in the second secondary boards. The third extension sections have free ends that are respectively fixed in the third secondary boards to thereby movably couple the third secondary boards to the second secondary boards.

The third secondary boards each form a third mounting hole corresponding to the third extension section of each of the third coupling axles. The third extension sections of the third coupling axles are respectively mounted in the third mounting holes so as to movably couple the third secondary boards to the second secondary boards.

The present invention also provides a pallet, which comprising a base board and first secondary boards movably coupled to two opposite sides of the base board, and first coupling axles connecting between the base board and the first secondary boards, the first coupling axles each comprising a first base and a first extension section extending from the first base, the first extension section forming a plurality of first flexible engagement keys at locations close to an end thereof that is adjacent to the first base, the base board forming first receiving sections respectively corresponding to the first bases and also forming first track channels respectively corresponding to the first extension sections, the first track channels each forming therein a plurality of groups of first retention slots corresponding to the first flexible engagement keys, the first bases being respectively received in the first receiving slots and movable in the first receiving slots, the first flexible engagement keys being receivable in and retained by the first retention slots to retain the first coupling axles in the base board, the first extension sections having free ends respectively fixed in the first secondary boards to movably couple the first secondary boards to the base board;

wherein the first secondary boards each form a first mounting hole corresponding to the first extension section of each of the first coupling axles, the first extension sections of the first coupling axles being mounted in the first mounting holes so as to movably couple the first secondary boards to the base board;

wherein the first extension section of each of the first coupling axles is cylindrical and the first flexible engagement keys are circumferentially formed on an outside surface of the first extension section at locations close to the first base;

wherein the first flexible engagement keys are of a number of four and each of the groups of the first retention slots comprises four slots, the four slots respectively receiving four first flexible engagement keys;

wherein the base board is rectangular and has another two sides to which second secondary boards are movably coupled, the second secondary boards being movably connected to the base board by second coupling axles;

wherein the second coupling axles each comprise a second base and a second extension section extending from the second base, the second extension section forming a plurality of second flexible engagement keys at locations close to an end thereof that is adjacent to the second base, the base board forming second receiving sections corresponding to the second bases and also forming second track channels corresponding to the second extension sections, the second track channels each forming therein a plurality of groups of second retention slots corresponding to the second flexible engagement keys, the second bases being respectively received in the second receiving slots and being movable in the second receiving slots, the second resilient engagement keys being receivable in and retained by the respective second retention slots to thereby retain the second coupling axles in the base board, the second extension sections having free ends that are respectively fixed in the second secondary boards to thereby movably couple the second secondary boards to the base board;

wherein the second secondary boards each form a second mounting hole corresponding to the second extension section of each of the second coupling axles, the second extension sections of the second coupling axles being respectively mounted in the second mounting holes so as to movably couple the second secondary boards to the base board;

further comprising third secondary boards movably connected to opposite sides of each of the second secondary boards, the third secondary boards being movably connected to the second secondary boards by third coupling axles;

wherein the third coupling axles each comprise a third base and a third extension section extending from the third base, the third extension section forming a plurality of third flexible engagement keys at locations close to an end thereof that is adjacent to the third base, the second secondary boards each forming third receiving sections corresponding to the third bases and also forming third track channels corresponding to the third extension sections, the third track channels each forming therein a plurality of groups of third retention slots corresponding to the third flexible engagement keys, the third bases being respectively received in the third receiving slots and being movable in the third receiving slots, the third resilient engagement keys being receivable in and retained by the respective third retention slots to thereby retain the third coupling axles in the second secondary boards, the third extension sections having free ends that are respectively fixed in the third secondary boards to thereby movably couple the third secondary boards to the second secondary boards; and wherein the third secondary boards each form a third mounting hole corresponding to the third extension section of each of the third coupling axles, the third extension sections of the third coupling axles being respectively mounted in the third mounting holes so as to movably couple the third secondary boards to the second secondary boards.

The efficacy of the present invention is that the present invention provides a pallet, which comprises coupling axles that makes positions between the secondary boards and the base boards and positions between secondary boards to be adjustable for adjusting the size of the pallet, enabling application of the pallet to package of liquid crystal panels of various sizes. The pallet can be shrunk to the minimum volume in warehousing and transportation so that the amount of space occupied is small and the transportation cost is effectively reduced.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
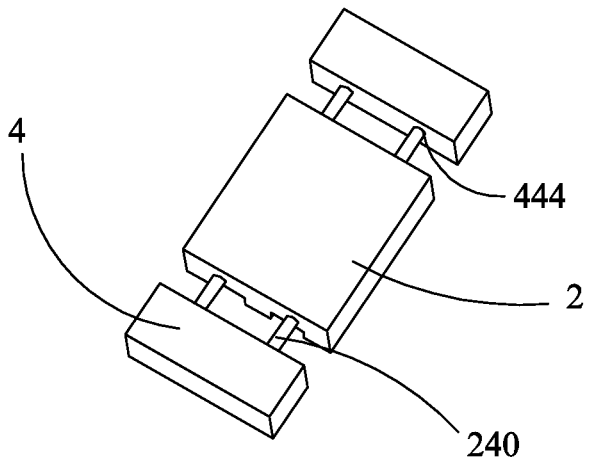
FIG. 1 is a schematic view showing the structure of a pallet according to an embodiment of the present invention.
Figure 2:
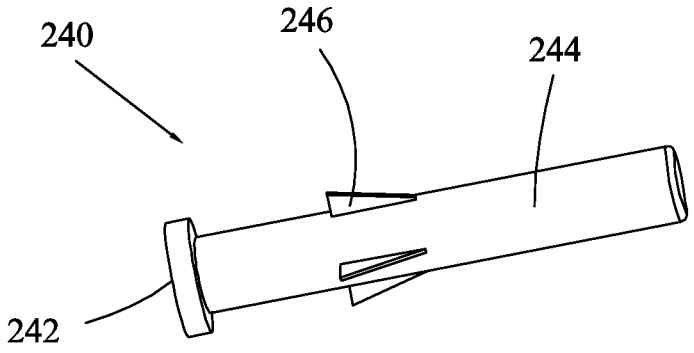
FIG. 2 is a schematic view showing the structure of a first coupling axle of the pallet according to the present invention.
Figure 3:
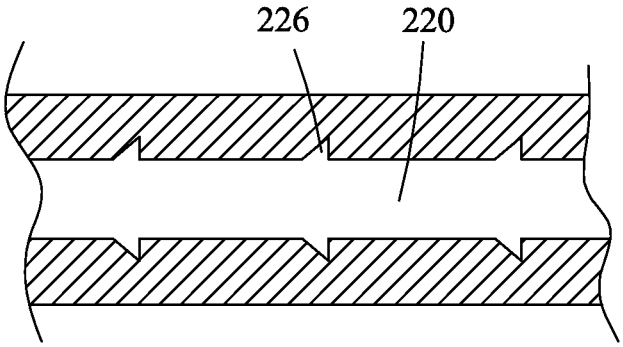
FIG. 3 is a cross-sectional view showing a first track channel of the pallet according to the present invention.

Referring to FIGS. 1-3, the present invention provides a pallet, which comprises a base board 2, first secondary boards 4 movably coupled to two opposite sides of the base board 2, and first coupling axles 240 connecting between the base board 2 and the first secondary boards 4. The first secondary boards 4 are movable along the first coupling axles 240 with respect to the base board 2 so as to change the overall size of the pallet to thereby widen the applications thereof and lower down the manufacturing cost.

The first coupling axles 240 each comprise a first base 242 and a first extension section 244 extending from the first base 242. The first extension section 244 forms a plurality of first flexible engagement keys 246 at locations close to an end thereof that is adjacent to the first base 242. The base board 2 forms first receiving sections (not shown) corresponding to the first bases 242 and also forms first track channels 220 corresponding to the first extension sections 244. The first track channels 220 each form therein a plurality of groups of first retention slots 226 corresponding to the first flexible engagement keys 246. The first bases 242 are respectively received in the first receiving slots and are movable in the first receiving slots. The first resilient engagement keys 246 are receivable in and retained by the respective first retention slots 226 to thereby retain the first coupling axles 240 in the base board 2. The first extension sections 244 have free ends that are respectively fixed in the first secondary boards 4 to thereby movably couple the first secondary boards 4 to the base board 2.

The first secondary boards 4 each form a first mounting hole 444 corresponding to the first extension section 244 of each of the first coupling axles 240. The first extension sections 244 of the first coupling axles 240 are respectively mounted in the first mounting holes 444 so as to movably couple the first secondary boards 4 to the base board 2. The number of the first coupling axles 240 can be determined according to practical needs. In the instant embodiment, each of the first secondary boards 4 is connected by two first coupling axles 240 to the base board 2.

In the instant embodiment, the first extension section 244 of each of the first coupling axles 240 is cylindrical and the first flexible engagement keys 246 are circumferentially formed on an outside surface of the first extension section 244 at locations close to the first base 242. The first flexible engagement keys 246 are of a number of four. Each group of first retention slots 226 formed inside each of the first track channels 220 comprises four slots for respectively receiving the four first flexible engagement keys 246.

When it is desired to have a large-sized pallet, the first secondary boards 4 are pulled outward. The flexible engagement keys 246, being flexible, undergo elastic deformation when acted upon by a force to disengage from the ends of the first retention slots 226 that are close to the first receiving slots for movement along the first track channels 220 and restore shape, through elastic deformation, to engage and thus retain in the next group of first retention slots 226 when reach the next group of first retention slots 226 thereby realizing expansion of the size of the pallet. When it is desired to have a small-sized pallet, such a pallet can be realized through pushing the first secondary boards 4 into the base board 2 and the operation is easy.

It is noted that sizes of the base board 2 and the first secondary boards 4 can be properly designed according to practical needs and the first flexible engagement keys 246 of the first coupling axles 24 and the plurality of groups of first retention slots 226 formed in the first track channels 220 can be properly designed in respect of the locations and spacing intervals according to practical needs. For example, the design can be made for a pallet that is capable of transporting liquid crystal display panel of a size of 28 inches, 32 inches, or 46 inches. The details of parameters can be set according to practical needs and this is of no influence on the technical effectiveness of the present invention.

Figure 4:
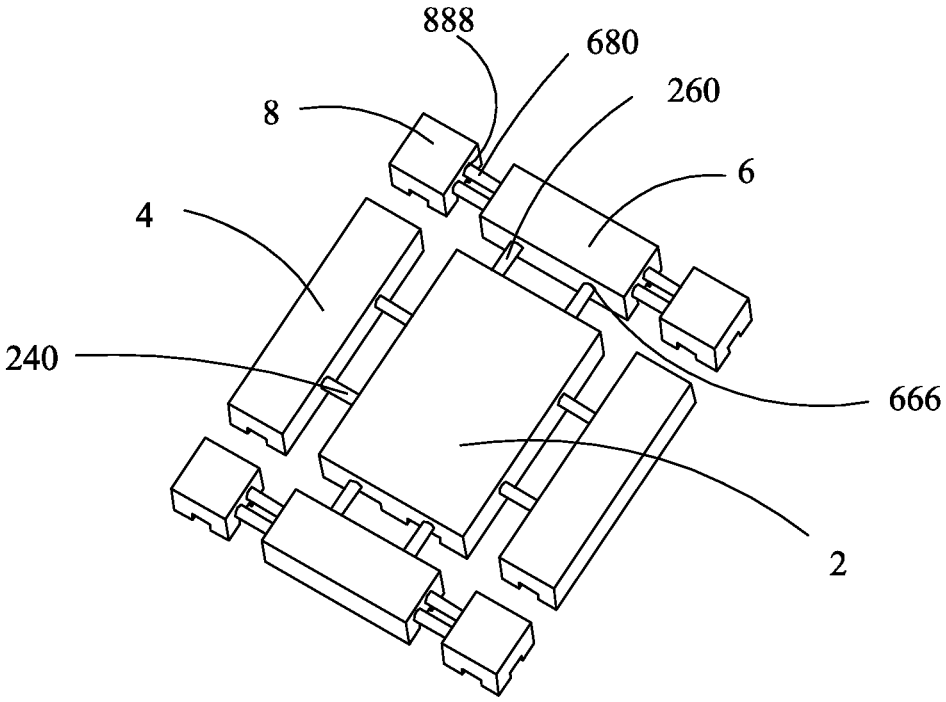
FIG. 4 is a schematic view showing the structure of a pallet according to another embodiment of the present invention.
Figure 5:
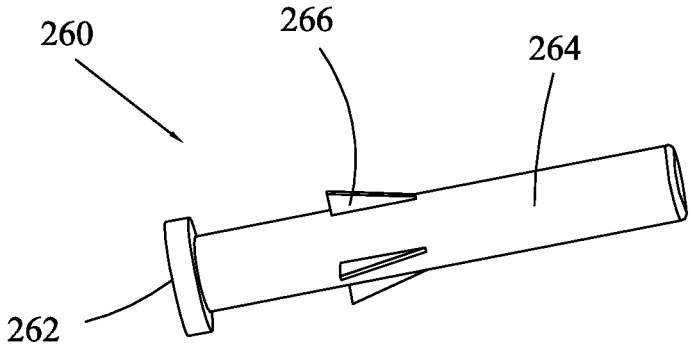
FIG. 5 is a schematic view showing the structure of a second coupling axle of the pallet according to the present invention.
Figure 6:
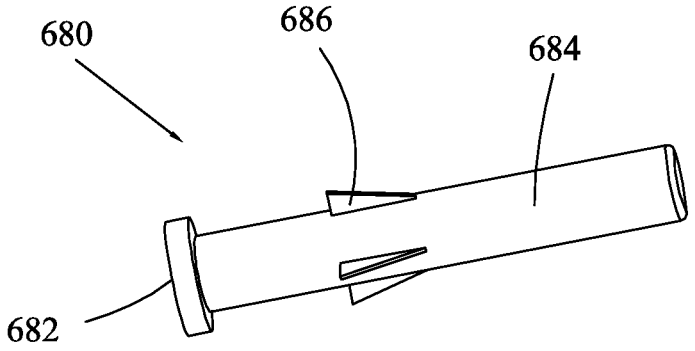
FIG. 6 is a schematic view showing the structure of a third coupling axle of the pallet according to the present invention.

Referring to FIGS. 4-6, schematic views are given to illustrate the structure of a pallet according to another embodiment of the present invention. In the instant embodiment, the base board 2 is rectangular and has another two sides to which second secondary boards 6 are movably coupled. The second secondary boards 6 are movably connected to the base board 2 by second coupling axles 260.

The second coupling axles 260 each comprise a second base 262 and a second extension section 264 extending from the second base 262. The second extension section 264 forms a plurality of second flexible engagement keys 266 at locations close to an end thereof that is adjacent to the second base 262. The base board 2 forms second receiving sections (not shown) corresponding to the second bases 262 and also forms second track channels (not shown) corresponding to the second extension sections 264. The second track channels each form therein a plurality of groups of second retention slots (not shown) corresponding to the second flexible engagement keys 266. The second bases 262 are respectively received in the second receiving slots and are movable in the second receiving slots. The second resilient engagement keys 266 are receivable in and retained by the respective second retention slots to thereby retain the second coupling axles 260 in the base board 2. The second extension sections 264 have free ends that are respectively fixed in the second secondary boards 6 to thereby movably couple the second secondary boards 6 to the base board 2.

The second secondary boards 6 each form a second mounting hole 666 corresponding to the second extension section 266 of each of the second coupling axles 260. The second extension sections 264 of the second coupling axles 260 are respectively mounted in the second mounting holes 666 so as to movably couple the second secondary boards 6 to the base board 2. The number of the second coupling axles 260 can be determined according to practical needs. In the instant embodiment, each of the second secondary boards 6 is connected by two second coupling axles 260 to the base board 2.

In the instant embodiment, the pallet further comprises third secondary boards 8 movably connected to opposite sides of each of the second secondary boards 6. The third secondary boards 8 are movably connected to the second secondary boards 6 by third coupling axles 680.

The third coupling axles 680 each comprise a third base 682 and a third extension section 684 extending from the third base 682. The third extension section 684 forms a plurality of third flexible engagement keys 686 at locations close to an end thereof that is adjacent to the third base 682. The second secondary boards 6 each form third receiving sections (not shown) corresponding to the third bases 682 and also forms third track channels (not shown) corresponding to the third extension sections 684. The third track channels (not shown) each form therein a plurality of groups of third retention slots (not shown) corresponding to the third flexible engagement keys 686. The third bases 682 are respectively received in the third receiving slots and are movable in the third receiving slots. The third resilient engagement keys 686 are receivable in and retained by the respective third retention slots to thereby retain the third coupling axles 680 in the second secondary boards 6. The third extension sections 684 have free ends that are respectively fixed in the third secondary boards 8 to thereby movably couple the third secondary boards 8 to the second secondary boards 6.

The third secondary boards 8 each form a third mounting hole 888 corresponding to the third extension section 684 of each of the third coupling axles 680. The third extension sections 684 of the third coupling axles 680 are respectively mounted in the third mounting holes 888 so as to movably couple the third secondary boards 8 to the second secondary boards 6. The number of the third coupling axles 680 can be determined according to practical needs. In the instant embodiment, each of the third secondary boards 8 is connected by two third coupling axles 680 to the respective second secondary board 6

In summary, the present invention provides a pallet, which comprises coupling axles that makes positions between the secondary boards and the base boards and positions between secondary boards to be adjustable for adjusting the size of the pallet, enabling application of the pallet to package of liquid crystal panels of various sizes. The pallet can be shrunk to the minimum volume in warehousing and transportation so that the amount of space occupied is small and the transportation cost is effectively reduced.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A pallet, comprising a base board and first secondary boards movably coupled to two opposite sides of the base board, and first coupling axles connecting between the base board and the first secondary boards, the first coupling axles each comprising a first base and a first extension section extending from the first base, the first extension section forming a plurality of first flexible engagement keys at locations close to an end thereof that is adjacent to the first base, each of the first flexible engagement keys having a stop face that is substantially parallel to an extension direction of the first extension section and faces the first base and a camming face that is inclined with respect to the extension direction and faces away from the first base, the base board forming first receiving sections respectively corresponding to the first bases and also forming first track channels respectively corresponding to the first extension sections, the first track channels each forming therein a plurality of groups of first retention slots corresponding to the first flexible engagement keys, the first bases being respectively received in the first receiving sections and movable in the first receiving sections, the first flexible engagement keys being receivable in and retained by the first retention slots to retain the first coupling axles in the base board, the first extension sections having free ends respectively fixed in the first secondary boards to movably couple the first secondary boards to the base board.

2. The pallet as claimed in claim 1, wherein the first secondary boards each form a first mounting hole corresponding to the first extension section of each of the first coupling axles, the first extension sections of the first coupling axles being mounted in the first mounting holes so as to movably couple the first secondary boards to the base board.

3. The pallet as claimed in claim 1, wherein the first extension section of each of the first coupling axles is cylindrical and the first flexible engagement keys are circumferentially formed on an outside surface of the first extension section at locations close to the first base.

4. The pallet as claimed in claim 3, wherein the first flexible engagement keys are of a number of four and each of the groups of the first retention slots comprises four slots, the four slots respectively receiving four first flexible engagement keys.

5. The pallet as claimed in claim 1, wherein the base board is rectangular and has another two sides to which second secondary boards are movably coupled, the second secondary boards being movably connected to the base board by second coupling axles.

6. The pallet as claimed in claim 5, wherein the second coupling axles each comprise a second base and a second extension section extending from the second base, the second extension section forming a plurality of second flexible engagement keys at locations close to an end thereof that is adjacent to the second base, the base board forming second receiving sections corresponding to the second bases and also forming second track channels corresponding to the second extension sections, the second track channels each forming therein a plurality of groups of second retention slots corresponding to the second flexible engagement keys, the second bases being respectively received in the second receiving sections and being movable in the second receiving sections, the second flexible engagement keys being receivable in and retained by the respective second retention slots to thereby retain the second coupling axles in the base board, the second extension sections having free ends that are respectively fixed in the second secondary boards to thereby movably couple the second secondary boards to the base board.

7. The pallet as claimed in claim 6, wherein the second secondary boards each form a second mounting hole corresponding to the second extension section of each of the second coupling axles, the second extension sections of the second coupling axles being respectively mounted in the second mounting holes so as to movably couple the second secondary boards to the base board.

8. The pallet as claimed in claim 5 further comprising third secondary boards movably connected to opposite sides of each of the second secondary boards, the third secondary boards being movably connected to the second secondary boards by third coupling axles.

9. The pallet as claimed in claim 8, wherein the third coupling axles each comprise a third base and a third extension section extending from the third base, the third extension section forming a plurality of third flexible engagement keys at locations close to an end thereof that is adjacent to the third base, the second secondary boards each forming third receiving sections corresponding to the third bases and also forming third track channels corresponding to the third extension sections, the third track channels each forming therein a plurality of groups of third retention slots corresponding to the third flexible engagement keys, the third bases being respectively received in the third receiving sections and being movable in the third receiving sections, the third resilient engagement keys being receivable in and retained by the respective third retention slots to thereby retain the third coupling axles in the second secondary boards, the third extension sections having free ends that are respectively fixed in the third secondary boards to thereby movably couple the third secondary boards to the second secondary boards.

10. The pallet as claimed in claim 9, wherein the third secondary boards each form a third mounting hole corresponding to the third extension section of each of the third coupling axles, the third extension sections of the third coupling axles being respectively mounted in the third mounting holes so as to movably couple the third secondary boards to the second secondary boards.

11. A pallet, comprising a base board and first secondary boards movably coupled to two opposite sides of the base board, and first coupling axles connecting between the base board and the first secondary boards, the first coupling axles each comprising a first base and a first extension section extending from the first base, the first extension section forming a plurality of first flexible engagement keys at locations close to an end thereof that is adjacent to the first base, each of the first flexible engagement keys having a stop face that is substantially parallel to an extension direction of the first extension section and faces the first base and a camming face that is inclined with respect to the extension direction and faces away from the first base, the base board forming first receiving sections respectively corresponding to the first bases and also forming first track channels respectively corresponding to the first extension sections, the first track channels each forming therein a plurality of groups of first retention slots corresponding to the first flexible engagement keys, the first bases being respectively received in the first receiving sections and movable in the first receiving sections, the first flexible engagement keys being receivable in and retained by the first retention slots to retain the first coupling axles in the base board, the first extension sections having free ends respectively fixed in the first secondary boards to movably couple the first secondary boards to the base board;

wherein the first secondary boards each form a first mounting hole corresponding to the first extension section of each of the first coupling axles, the first extension sections of the first coupling axles being mounted in the first mounting holes so as to movably couple the first secondary boards to the base board;

wherein the first extension section of each of the first coupling axles is cylindrical and the first flexible engagement keys are circumferentially formed on an outside surface of the first extension section at locations close to the first base;

wherein the first flexible engagement keys are of a number of four and each of the groups of the first retention slots comprises four slots, the four slots respectively receiving four first flexible engagement keys;

wherein the base board is rectangular and has another two sides to which second secondary boards are movably coupled, the second secondary boards being movably connected to the base board by second coupling axles;

wherein the second coupling axles each comprise a second base and a second extension section extending from the second base, the second extension section forming a plurality of second flexible engagement keys at locations close to an end thereof that is adjacent to the second base, the base board forming second receiving sections corresponding to the second bases and also forming second track channels corresponding to the second extension sections, the second track channels each forming therein a plurality of groups of second retention corresponding to the second flexible engagement keys, the second bases being respectively received in the second receiving sections and being movable in the second receiving sections, the second flexible engagement keys being receivable in and retained by the respective second retention slots to thereby retain the second coupling axles in the base board, the second extension sections having free ends that are respectively fixed in the second secondary boards to thereby movably couple the second secondary boards to the base board;

wherein the second secondary boards each form a second mounting hole corresponding to the second extension section of each of the second coupling axles, the second extension sections of the second coupling axles being respectively mounted in the second mounting holes so as to movably couple the second secondary boards to the base board;

further comprising third secondary boards movably connected to opposite sides of each of the second secondary boards, the third secondary boards being movably connected to the second secondary boards by third coupling axles;

wherein the third coupling axles each comprise a third base and a third extension section extending from the third base, the third extension section forming a plurality of third flexible engagement keys at locations close to an end thereof that is adjacent to the third base, the second secondary boards each forming third receiving sections corresponding to the third bases and also forming third track channels corresponding to the third extension sections, the third track channels each forming therein a plurality of groups of third retention slots corresponding to the third flexible engagement keys, the third bases being respectively received in the third receiving sections and being movable in the third receiving sections, the third resilient engagement keys being receivable in and retained by the respective third retention slots to thereby retain the third coupling axles in the second secondary boards, the third extension sections having free ends that are respectively fixed in the third secondary boards to thereby movably couple the third secondary boards to the second secondary boards; and wherein the third secondary boards each form a third mounting hole corresponding to the third extension section of each of the third coupling axles, the third extension sections of the third coupling axles being respectively mounted in the third mounting holes so as to movably couple the third secondary boards to the second secondary boards.

* * * * *